US009050232B2

(12) United States Patent
Jeyasurya et al.

(10) Patent No.: US 9,050,232 B2
(45) Date of Patent: Jun. 9, 2015

(54) STAND-ASSIST MANUAL WHEELCHAIR FOOTREST RETRACTION DEVICE

(71) Applicants: Jeswin Jeyasurya, Vancouver (CA); Jaimie Borisoff, Vancouver (CA)

(72) Inventors: Jeswin Jeyasurya, Vancouver (CA); Jaimie Borisoff, Vancouver (CA)

( * ) Notice: Subject to any disclaimer, the term of this patent is extended or adjusted under 35 U.S.C. 154(b) by 108 days.

(21) Appl. No.: 13/887,449

(22) Filed: May 6, 2013

(65) Prior Publication Data

US 2013/0292988 A1 Nov. 7, 2013

Related U.S. Application Data

(60) Provisional application No. 61/643,223, filed on May 4, 2012.

(51) Int. Cl.
*A61G 5/14* (2006.01)
*A61G 5/12* (2006.01)

(52) U.S. Cl.
CPC .. *A61G 5/14* (2013.01); *A61G 5/12* (2013.01); *A61G 2005/128* (2013.01)

(58) Field of Classification Search
CPC ..... A61G 2005/128; A61G 5/12; A61G 5/14; A61G 2005/1089; A61G 2005/1086
USPC ..... 297/423.19, 423.25, 423.26, 423.27, 297/423.29, DIG. 4; 280/304.1, 250.1, 280/288.4
See application file for complete search history.

(56) References Cited

U.S. PATENT DOCUMENTS

| | | | | |
|---|---|---|---|---|
| 1,591,529 | A * | 7/1926 | Guerber | 280/47.4 |
| 2,427,191 | A * | 9/1947 | Brink | 342/51 |
| 4,141,094 | A * | 2/1979 | Ferguson et al. | 5/85.1 |
| 6,338,493 | B1 * | 1/2002 | Wohlgemuth et al. | 280/30 |
| 6,422,653 | B1 | 7/2002 | Szczepanski et al. | |
| 6,880,845 | B1 * | 4/2005 | Broyles et al. | 280/250.1 |
| 7,347,497 | B2 | 3/2008 | Fujihara et al. | |

* cited by examiner

*Primary Examiner* — Sarah B McPartlin
(74) *Attorney, Agent, or Firm* — Ryan W. Dupuis; Kyle R. Satterthwaite; Ade & Company Inc

(57) ABSTRACT

A wheelchair footrest retraction device has been developed to allow wheelchair users to easily retract the footrest and have assistance as they rise from the wheelchair. The device includes a handle that can be rotated by the user from a horizontal to a vertical position where it can then be used to provide support as the user rises from the wheelchair. Rotation of the handle acts to retract the footrest through a series of linkages that transmit force from the handle to the footrest. The device also includes a support post that prevents the wheelchair from tipping forward as the user rises from the wheelchair.

20 Claims, 5 Drawing Sheets

STAND-ASSIST MANUAL WHEELCHAIR FOOTREST RETRACTION DEVICE

This application claims the benefit under 35 U.S.C. 119(e) of U.S. provisional application Ser. No. 61/643,223, filed May 4, 2013.

FIELD OF THE INVENTION

The present invention relates to the manipulation of manual wheelchair flip-up footrests. Specifically, the invention relates to a footrest retraction mechanism used to manually raise the wheelchair footrests and support users as they rise from the wheelchair.

BACKGROUND

Before exiting or entering a manual wheelchair, a user typically has to lean down and either swing away the footrest hangers to the side or lift the footrests to the vertical retracted position. Either motion can be difficult for some manual wheelchair users, particularly those with limited upper extremity mobility. Consequently, these users will constantly require help from caregivers to retract the footrest before they get in and out of wheelchairs. Retracting the footrests is also an awkward task for caregivers, who will have to bend over or crouch to raise the footrests.

After retracting the footrests the user must rise from a seated to a standing position to exit the wheelchair. Sit-to-stand is known to be a biomechanically challenging task in the older adult population. Research in sit-to-stand among older adults reveals that knee extensor strength can be a limiting factor in successfully rising from a chair. Research has also shown that functionally impaired seniors attempt to increase postural stability during sit-to-stand by flexing the trunk forward prior to rising, thus decreasing the center of mass/base of support (COM/BOS) separation at the instant of liftoff. Accordingly a method to guide an older user into a more functionally appropriate forward position before standing would be beneficial.

Previous attempts have been developed to address footrest retraction, including: U.S. Pat. Nos. 6,422,653; 7,347,497; 6,880,845. However, none of these devices possess mechanisms that additionally assist or support users with the sit-to-stand motion after the footrests have been retracted.

SUMMARY OF THE INVENTION

According to one aspect of the invention there is provided a wheelchair footrest retraction device for use on a wheelchair having a footrest frame portion and a footrest pivotally supported on the footrest frame portion for upward movement from a downward use position to an upper retracted position, the device comprising:

an upper bracket arranged to be mounted on the footrest frame portion;

a handle pivotally coupled to the upper bracket so as to be readily manipulated by a user of the wheelchair, the handle being movable in a forward direction of the wheelchair from a first position to a second position;

a footrest coupling arranged to be mounted on the footrest;

a linkage assembly operatively connected between the handle and the footrest coupling such that footrest is arranged to be displaced from the downward use position to the upper retracted position in response to forward movement of the handle from the first position to the second position.

The wheelchair footrest retraction mechanism is intended to be used on wheelchairs with individual pivoting footrests that retract to a vertical position. The device is designed such that the motion required to retract the footrests actually guides the seated user into a biomechanically functional position for standing and additionally provides a handle to push on to support and assist sit-to-stand from the wheelchair.

The retraction device is an accessory designed for simple attachment to existing wheelchairs with swing away, flip-up footrests. It is attached to the wheelchair via a clamping bracket mounted to the footrest hanger and a ball joint mounted to the footrest. A handled-lever pivoting about the bracket can be manipulated by the user such that motion of the handle retracts the footrest via two intermediate linkages that transmit force from the handle to the ball joint attached to the footrest.

Once the footrest is in the retracted position, the handle is well positioned for further use to support users with sit-to stand. The handle configuration encourages users to flex their trunks forward (increasing stability) and lean on the handle (reducing required knee strength) during the rise, thus promoting a safe and successful chair rise manoeuvre from the wheelchair.

When the user leans on the handles to assist with rising from the wheelchair, the vertical force on the handles will be transmitted to the footrest hangers. Since the hangers are located substantially forward of the front wheels in these conventional wheelchairs, a large vertical force will cause the wheelchair to tip forward during the assisted sit-to-stand motion.

According to a second aspect of the present invention there is provided a wheelchair anti-tipping mechanism for use on a wheelchair having a footrest frame portion and a footrest pivotally supported on the footrest frame portion for upward movement from a downward use position to an upper retracted position, the mechanism comprising:

a support member arranged to be pivotally supported on the footrest frame portion so as to be movable from a raised position in proximity to the footrest to a support position extending downwardly from a bottom end of the footrest frame portion in proximity to the ground responsive to movement of the footrest from the downward use position to the upper retracted position.

The anti-tipping mechanism prevents a potentially dangerous forward tip of the wheelchair during the hand supported sit-to-stand movement. It consists of a torsion spring-loaded post mounted to the bottom of the footrest hanger. When the footrest is in the horizontal position, the post also remains in a horizontal position directly underneath the footrest, thus remaining in a position that will not interfere with the normal rolling operation of the wheelchair. When the footrest is raised to the retracted vertical position, the torsion spring causes the post to rotate in the opposition direction such that the post moves into a vertical position directly under the line of vertical applied force, and serves to stop forward tipping of the wheelchair. When the footrest is lowered back to the horizontal position it applies a force onto the post that causes the post to rotate back into the horizontal position.

In summary, the invention provides the following: an easy to attach accessory to conventional wheelchairs; a levered device, simple to use, that requires little upper-extremity strength; a method for retracting wheelchair footrests using a motion that encourages proper biomechanics of sit-to-stand; and a handle with built-in anti-tippers that can be used to assist with standing.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Overall System

Figure 1A:
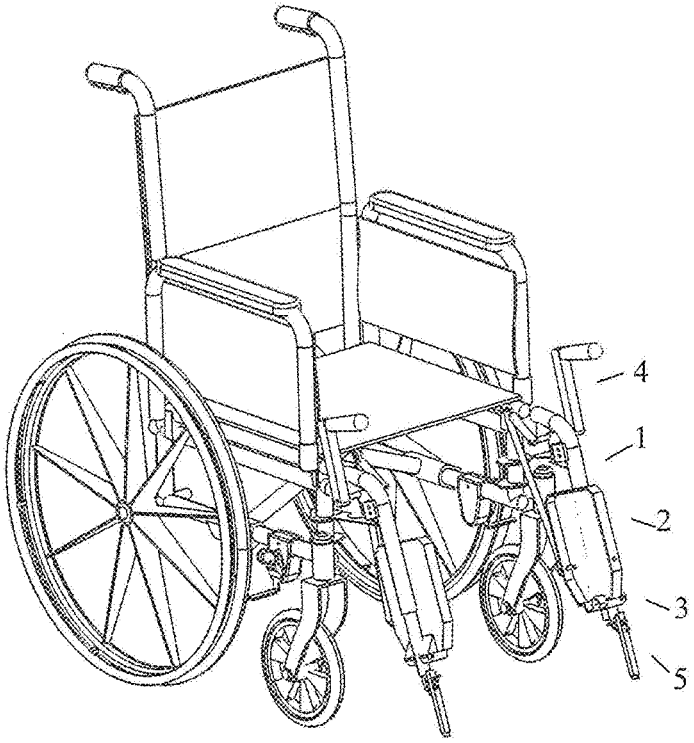
FIGS. 1*a* and 1*b* are perspective views of a wheelchair with the retraction device mounted to the footrest and footrest hanger.
Figure 1B:
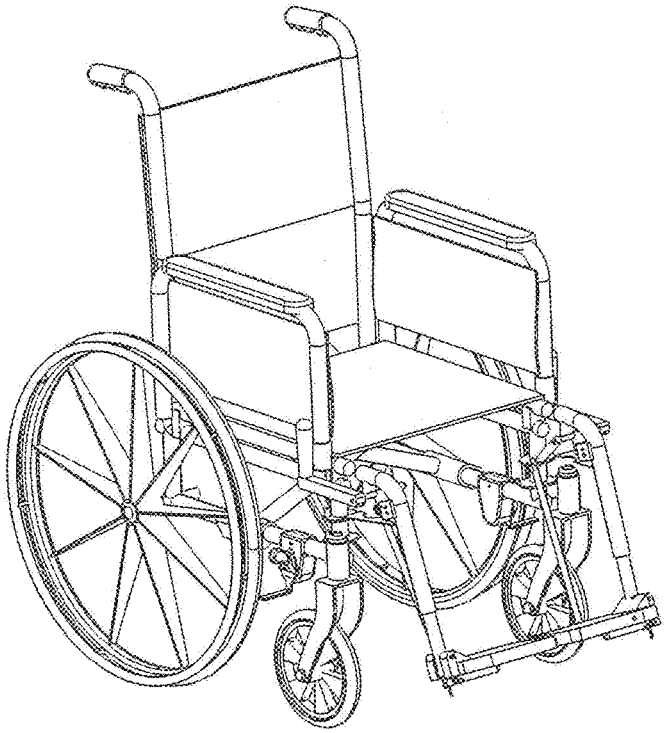

FIG. 1*a* is a perspective view of a wheelchair with the footrest retraction device installed and with the footrests in the vertical retracted position. The footrest system of a typical wheelchair consists of a footrest hanger 1 and a footrest 2 mounted to the hanger at a pivot point 3. This type of wheelchair swing-away footrest system is well known in the industry and not further described here. The retraction device consists of a retraction mechanism 4 mounted to the hanger 1 and the footrest 2, and an anti-tip mechanism 5 mounted to the base of the hanger. FIG. 1*b* is the same as FIG. 1*a*, except the footrests are in the horizontal use position.

Footrest Retraction Mechanism

Figure 2A:
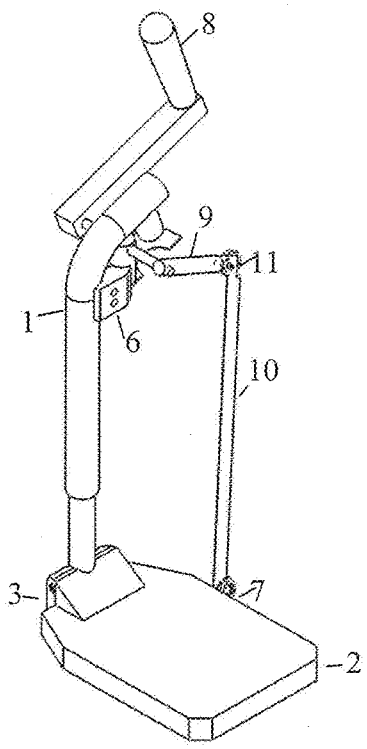
FIGS. 2*a* and 2*b* are perspective views of the hanger and footrest with the retraction device attached.
Figure 2B:
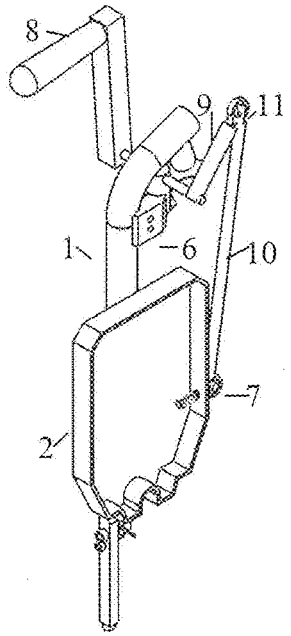

FIGS. 2*a* and 2*b* are perspective views of the hanger and footrest showing the retraction device and footrests in the horizontal use and vertical retracted positions respectively. The footrest retraction mechanism is mounted onto the footrest using a support bracket 6 (a wheelchair brake clamp) clamped to the hanger and a ball joint shaft 7 mounted into a clearance hole in the footrest 2. Force applied by the user to the handled-lever 8 is transmitted through a shaft 12 that pivots about a hole in interface piece 13 clamped to bracket 6. Shaft 12 connects to an intermediate linkage 9. Linkage 9 is attached to the footrest linkage 10 by a ball joint 11, resulting in a vertical force at the ball joint 7. This vertical force at the ball joint 7 provides a torque about the footrest pivot 3 that rotates the footrest 2 to the vertical retracted position, FIG. 2*b*. When the footrest 2 is in the vertical retracted position, the ball joint 11 attached into the intermediate linkage 9 and pinned to the footrest linkage 10 is in a position approximately co-planer with the highest point of the hanger. Consequently, the ball joint will not interfere with the underside of the wheelchair user's thighs when the footrests are retracted into the vertical position.

Figure 3:
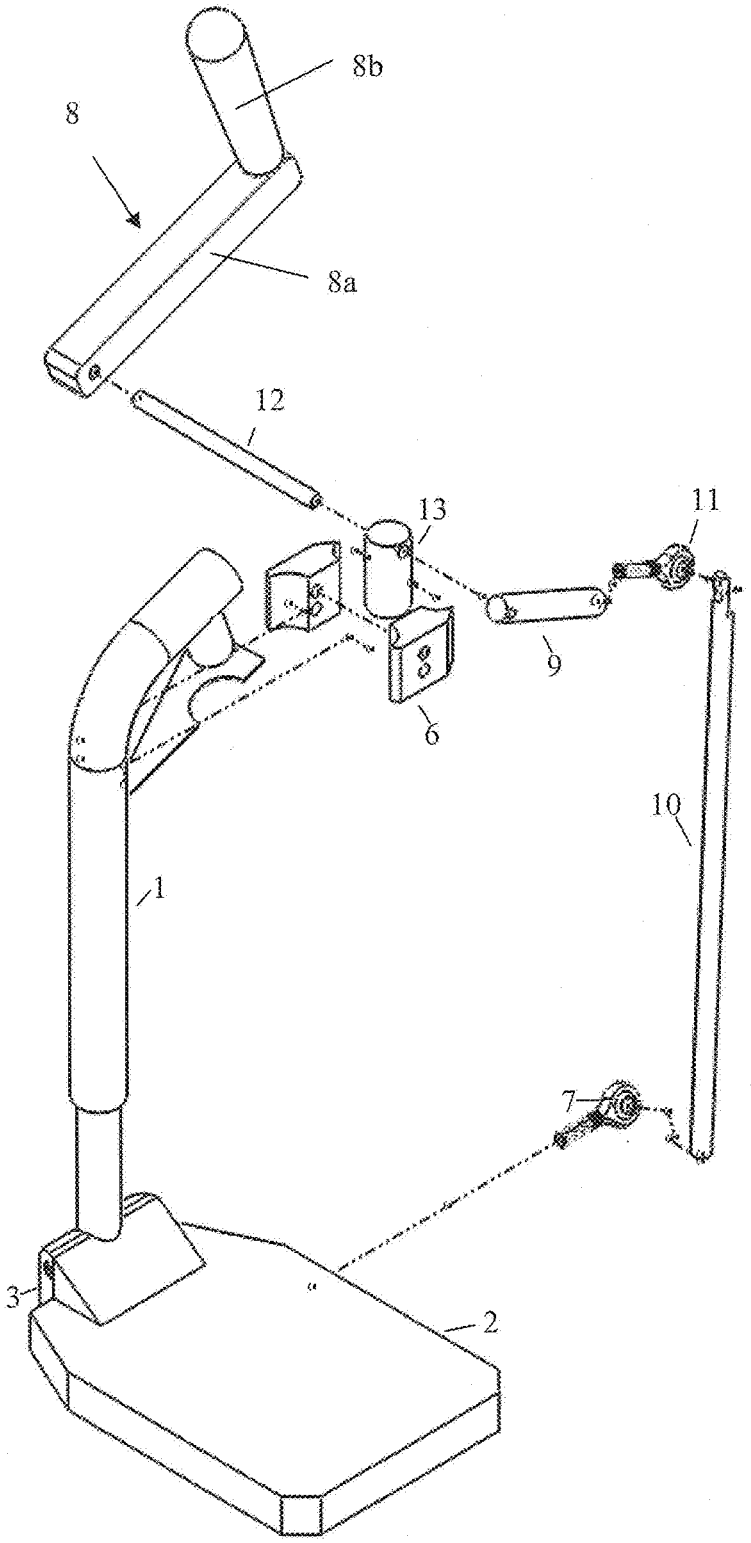
FIG. 3 is an exploded view of the retraction mechanism mounted to the footrest and footrest hanger.

FIG. 3 is an exploded view of the retraction mechanism mounted to the footrest and hanger. The handle linkage 8 is pinned on one end to a torque transmission shaft 12 that transmits torque to the intermediate linkage 9 pinned to the other end of the torque transmission shaft 12. The handle linkage is show as a solid piece, but the preferred embodiment will be adjustable in length using a sliding bracket system or some other similar method. An interface piece 13 clamped to the support bracket 6 holds the torque transmission shaft such that it is free to rotate axially but is constrained from all other rotations and translations. A ball joint shaft 11 is threaded into the end of the intermediate linkage 9 opposite to the end pinned to the torque transmission shaft 12. The threaded fit enables length adjustability of the intermediate linkage. The footrest linkage 10 is pinned at the top end to the ball joint 11 attached to the intermediate linkage 9 and pinned at the bottom end to the ball joint 7 attached to the footrest 2. The footrest linkage is shown as a solid rod, but the preferred embodiment will be adjustable in length, using either a threaded rod mounted into a female threaded tube or a smooth rod mounted into a smooth tube and held in place using a compression fitting. The retraction mechanism is mounted via the support bracket 6 clamped to the hanger 1 and the ball joint 7 pinned to the rear edge of the footrest 2.

As the user pushes the handle to retract the footrest, the handle moves forward, thus encouraging the user to flex his trunk forward as desired according to proper sit-to-stand biomechanics [6] and as normal in functionally impaired elderly adults [5]. When the footrest is fully retracted, the handle is approximately parallel to the ground and provides a hand support that serves to both stabilize the user and reduce the knee torque required to rise from the wheelchair. The end result is safe and successful sit-to-stand raising maneuvers from the wheelchair.

Referring back to FIG. 3, the adjustability and simplicity of mounting enables the footrest retractor to be mounted to a wide variety of wheelchair footrests. The only modification to the footrest is a single hole drilled in to the footrest 2 where the ball joint 7 is mounted. The clamped mount of the support bracket 6 on the hanger 1 enables vertical adjustment of the bracket along the hanger tubing 1. This support bracket will be designed to fit the two most common hanger tube sizes of ⅞" and 1" diameter but can be adapted to fit other tube sizes. Finally, the adjustability of the intermediate linkage 9 and the footrest linkage 10 will help fit the retraction mechanism to different footrest hanger configurations, and the adjustability of the handle linkage 8 will enable sit-to-stand support at varying heights.

A further benefit of this design is that mounting the linkage components on the inside of the wheelchair hanger protects the retraction mechanism from incidental contact since the outside of the hanger will be the first contact point with the environment. Furthermore this configuration also minimizes width increase of the wheelchair footrest and hanger system, so that the user can maneuver the wheelchair in the same manner as prior to mounting the footrest retraction device. Once the footrest is in the vertical retracted position, the hanger can be removed and remounted to the wheelchair, also in the same manner as prior to the addition of the retraction device to the footrest.

Anti-Tip Mechanism

Figure 4:
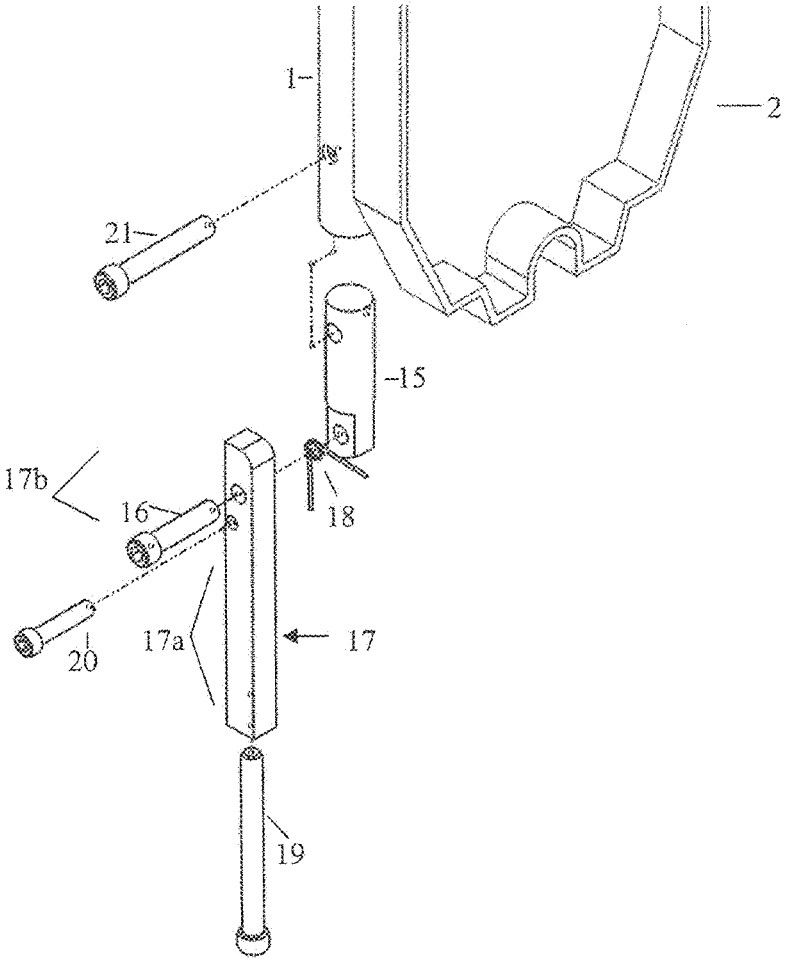
FIG. 4 is an exploded view of the anti-tipper mechanism mounted to the hanger.

FIG. 4 is an exploded view of the anti-tipper mechanism mounted to the hanger and in the extended position. The mechanism has an interface piece 15 that mounts to the underside of the hanger 1. The conventional wheelchair hanger is comprised of a hollow tube with a thru hole near the bottom so that the footrest 2 can be mounted to the hanger using a bolt 21. The interface piece 15 has a hole near its top edge that is aligned with the hole in the footrest hanger 1 so that the same bolt 21 that mounts the footrest to the hanger also holds the interface piece in place. A threaded hole near the bottom edge of the interface piece 15 allows a shoulder bolt 16 to constrain in place a support post 17 and a torsion spring 18. A clearance hole in the support post 17 allows the post to rotate freely about the shoulder of the bolt 16, and a 90° or 120° torsion spring 18 attached to the support post 17 and interface piece 15 biases the support post to the vertical position. The support post 17 has an extension piece 19 threaded into it to allow height adjustment of the post. Adjustment of the extension piece 19 will allow the anti-tip mechanism to match footrests with varying heights from the floor.

Figure 5A:
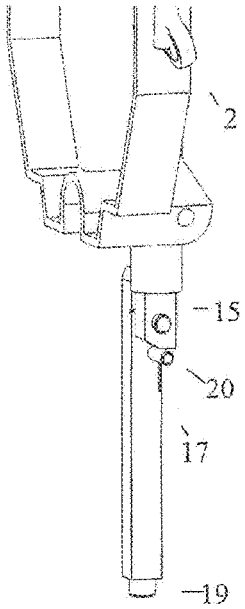
FIGS. 5*a* and 5*b* is a perspective view of the anti-tipper mechanism mounted to the hanger.
Figure 5B:
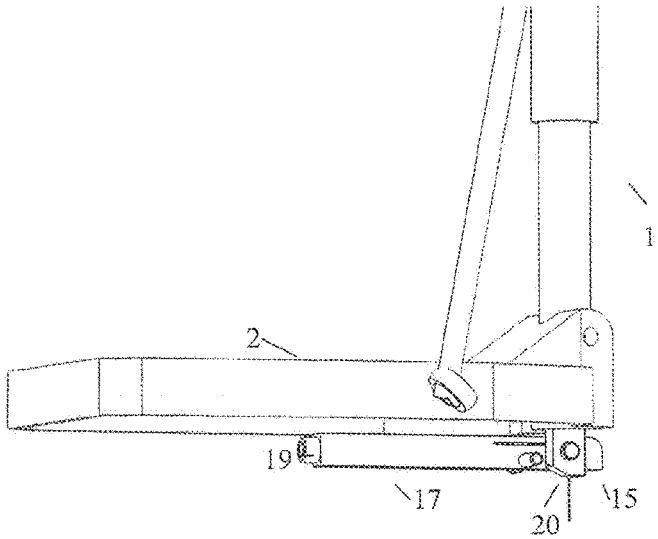
Figure 6A:
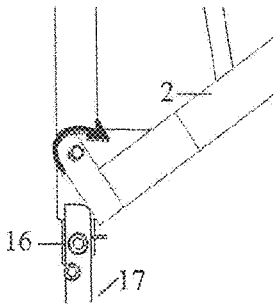
FIGS. 6*a*, 6*b*, 6*c*, and 6*d* are frame-by-frame views of the anti-tipping mechanism being retracted into the horizontal use position.
Figure 6B:
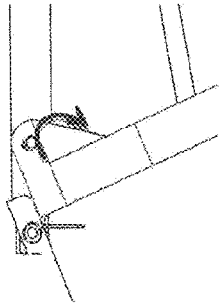
Figure 6C:
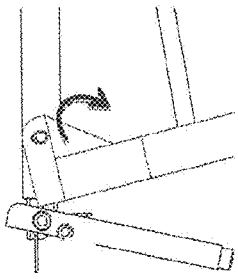
Figure 6D:
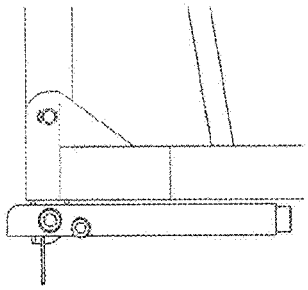

FIG. 5*a* shows the footrest platform in the vertical position. A stud 20 prevents motion of the support post beyond 90°. A diagonal cut in the interface piece 15 prevents this stud 20 from interfering with the interface piece 15 as the support post 17 rotates to the horizontal position, FIG. 5*b*.

FIGS. 6*a*, 6*b*, 6*c*, and 6*d* are frame-by-frame views of the anti-tipping mechanism being rotated into the horizontal position through a force applied by the footrest as the footrest is lowered into the horizontal use position. As shown in the figures, when the footrest 2 is being reset to the horizontal use position, the motion of the rear edge of the footrest platform pushes the top edge of the support post 17. This causes the support post to rotate about the shoulder bolt 16 from the vertical position to the horizontal position. This motion simultaneously winds up the torque spring so that when the footrest platform is raised, the support post springs back to the vertical position.

A benefit of this retraction system is the minimal modifications made to the hanger. No additional drilling or clamping is required since the interface piece is held in place by the same bolt that constrains the footrest to the hanger. The interface piece can also be fabricated in different diameters to accommodate varying hanger tube internal diameters.

Another benefit of the system is that there is minimal space taken up underneath the footrest when the footrests are in the horizontal use position since the support post is directly underneath and parallel to the footrest. The spring energized system ensures that the support post defaults to the vertical position when the footrest is retracted to the vertical position.

As described above, the wheelchair footrest retraction device is generally intended for use on a wheelchair having a main frame upon which a pair of footrest frame portions, referred to as hangers 1 above, are supported. The footrest frame portions support respective footrests 2 thereon in which each footrest is pivotable about a respective pivot axis oriented generally in the forward direction of the wheelchair between a downward use position extending horizontally inward towards the opposing footrest and an upper retracting position extending generally upward parallel and alongside a respective main frame member of the footrest frame portion 1.

The upper bracket is arranged to be clamped onto one or more frame members of the footrest frame portion so as to be moveable together with the footrest frame portion relative to the main frame of the wheelchair. The upper bracket includes a clamping portion or support bracket 6 which clamps an intermediate body or an interface piece 13 in fixed relation to the frame member of the footrest assembly such that the body 13 and the clamp 6 collectively define the upper bracket upon which the handled lever 8 is supported.

A pivot shaft 12 is pivotally supported on the body 13 of the upper bracket assembly so as to be pivotal about a respective longitudinal axis which is oriented generally horizontally and perpendicularly to a forward direction of the wheelchair. The handled lever 8 is fixed to an outer end of the pivot shaft 12 at the outer side of the footrest frame portion while the linkage assembly which connects to the footrest is connected at the inner end of the pivot shaft on the opposing side of the footrest frame portion relative to the handled lever 8.

The handled lever 8 includes an arm portion 8*a* which is fixed at one end to the outer end of the pivot shaft to extend radially therefrom to an opposing end upon which a grip portion 8*b* is fixed. In this manner, the arm portion 8*a* and the grip portion 8*b* are pivotal together with the pivot shaft relative to the upper bracket assembly fixed onto the footrest frame portion.

The handle 8 is moveable from a first position corresponding to the downward use position of the footrest to a second position corresponding to the upper retracted position of the footrest. In the first position, the arm portion extends generally rearward and the grip portion extends generally upward from the outer end of the arm portion such that the grip portion does not substantially protrude forwardly beyond the sides of the main frame of the wheelchair.

The handle is pivoted upwardly and forwardly from the first position to the second position such that in the second position, the arm portion extends generally upward near vertical and the grip portion protrudes forwardly from the arm portion. In this manner, the grip portion of the handle is rotated over center from the first position to the second position such that downward force on the grip portion in the second position opposes movement of the handle from the second position back to the first position.

In some instances, a stop member can be provided on the upper bracket assembly against which the handle is positively engaged in the second position so as to prevent continued movement of the handle from the first position to the second position beyond the second position.

Also as described above, the linkage assembly includes a first linkage or crank 9 fixed to the inner end of the pivot shaft 12 to extend radially therefrom. Typically in the first position of the handle corresponding to the downward use position of the footrest, the crank 9 extends generally rearward from the pivot shaft to an opposing end which supports the ball joint 11 thereon. Once rotated to the second position, the crank 9 extends generally upward so that the ball joint 11 is raised as the handle is displaced from the first position to the second position.

The linkage assembly further includes the second ball joint 7 which defines a footrest coupling arranged to be mounted to the footrest along a rear edge thereof at a location spaced inward towards the opposing footrest relative to the pivot axis of the footrest on the footrest frame portion when in the downward use position. The link member or linkage 10 is coupled at opposing top and bottom ends on the ball joint 11 and ball joint 7 respectively. The link member 10 is a rigid, non-elastic member which causes the footrest coupling 7 to be raised together with the link member 10 and the ball joint 11 at the end of the crank 9 to raise the footrest from the downward use position to the upper retracted position when the handle is rotated from the first position to the second position.

The anti-tipping mechanism as described above is arranged so that the support post or support member 17 is pivotally supported on the footrest frame portion so as to be moveable from a raised position in proximity to the footrest in the downward use position of the footrest to a support position in which the support member extends downwardly beyond the bottom end of the footrest frame portion. The bottom end of the support member is in proximity to the ground in the support position so as to be much lower in the support position than in the raised position.

The support member is moveable from the raised position to the support position responsive to movement of the footrest from the downward use position to the upper retracted position automatically without any additional actuation required on the part of the user.

The support member 17 is supported on the bottom end of the main frame member of the footrest frame portion by a mounting body or an interface piece 15. The body 15 is inserted upwardly into the hollow tube forming the main frame member of the footrest frame portion and is retained fixed in relation thereto using the main bolt 21 that retains the footrest on the footrest frame portion and which further defines the pivot axis of the footrest relative to the frame portion between the downward use position and the upper retracted position. The bottom end of the body 15 protrudes downwardly beyond the bottom end of the main frame member of the footrest frame portion so as to protrude below the bottom end of the footrest in the downward use position.

The shoulder bolt 16 pivotally couples the support member 17 to the bottom end of the body 15 at a location spaced below the bottom end of the footrest. The support member includes a leg portion 17*a* which extends downwardly from the pivot axis of the support member defined by the shoulder bolt 16 when in the support position of the support member. A remaining portion of the support member which extends upwardly from the pivot axis in the support position defines a footrest engaging portion 17*b* which is diametrically opposite from the leg portion 17*a*.

The leg portion and footrest engaging portion effectively comprise opposing ends of a continuous elongate body that defines the support member and which locates the pivot axis at an intermediate location thereon. The elongate body of the support member is arranged to be substantially parallel to the main frame member of the footrest frame portion in the support position.

The leg portion 17*a* of the support member locates the extension piece 19 threaded therein such that adjustment of the extension piece permits the length of the support member extending downwardly from the frame portion in the support position to be adjustable.

When the footrest assembly is raised into the upper retracted position, it no longer engages the footrest engaging portion 17*b* such that the torsion spring 18 is the only force acting on the support member to bias the support member from the raised position to the support position.

The stud 20 mounted on the support member 17 is arranged to contact the bottom end of the body 15 in the support position such that the bottom of the body 15 acts as a stop member arranged to be fixed relative to the footrest frame portion against which the stud 20 of the support members 17 is arranged to positively engage in the support position. The stop member thus prevents continued movement of the support member 17 from the raised position towards the support position beyond the support position.

As the footrest assembly is lowered into the downward use position, the bottom end of the footrest assembly engages the footrest engaging portion 17*b* at a location spaced above the pivot axis defined by the shoulder bolt 16 to urge rotation of the support member 17 from the support position to the raised position with continued movement of the footrest assembly into the downward use position. Once in the downward use position, the support member is fully pivoted into the raised position thereof so as to be oriented generally horizontally and parallel alongside the bottom of the footrest.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A wheelchair footrest retraction device for use on a wheelchair having a footrest frame portion and a footrest pivotally supported on the footrest frame portion for upward movement from a downward use position to an upper retracted position, the device comprising:

an upper bracket arranged to be mounted on the footrest frame portion;

a handle pivotally coupled to the upper bracket so as to be readily manipulated by a user of the wheelchair, the handle being movable upwardly and in a forward direction of the wheelchair from a first position to a second position;

a footrest coupling arranged to be mounted on the footrest;

a linkage assembly operatively connected between the handle and the footrest coupling such that the footrest is arranged to be displaced from the downward use position to the upper retracted position in response to forward movement of the handle from the first position to the second position.

2. The device according to claim 1 wherein the handle includes an arm portion pivotally coupled to the upper bracket and a grip portion supported on the arm portion for pivotal movement therewith relative to the upper bracket, the grip portion being oriented in the second position such that downward force on the grip portion opposes movement of the handle from the second position to the first position.

3. The device according to claim 1 wherein the handle includes an arm portion pivotally coupled to the upper bracket and a grip portion supported on the arm portion for pivotal movement therewith relative to the upper bracket and wherein at least the grip portion of the handle is rotated forwardly of a pivot axis of the handle from the first position to the second position.

4. The device according to claim 1 wherein the handle includes an arm portion pivotally coupled to the upper bracket and a grip portion supported on the arm portion for pivotal movement therewith relative to the upper bracket, the grip portion extending forwardly from the arm portion in the second position.

5. The device according to claim 4 wherein the arm portion extends upwardly from the upper bracket to the grip portion in the second position.

6. The device according to claim 1 further comprising a stop member fixed relative to the upper bracket, the handle being arranged to positively engage the stop member in the second position so as to prevent continued movement from the first position towards the second position beyond the second position.

7. The device according to claim 1 further comprising a pivot shaft pivotally supported on the upper bracket, the handle being fixed to the pivot shaft on one side of the footrest frame portion and the linkage assembly being coupled to pivot shaft on an opposing side of the footrest frame portion relative to the handle.

8. The device according to claim 1 wherein the footrest coupling is arranged to be mounted to the footrest at a rear edge of the footrest at a location spaced inwardly towards an opposing footrest of the wheelchair relative to a pivotal connection of the footrest to the footrest frame portion.

9. The device according to claim 1 wherein the footrest coupling comprises a ball joint.

10. The device according to claim 1 further comprising a pivot shaft pivotally supported on the upper bracket upon which the handle is fixed for pivotal movement therewith relative to the upper bracket, the linkage assembly comprising:

a crank fixed to the pivot shaft for pivotal movement therewith relative to the upper bracket; and a link member extending between a first end pivotally coupled the crank and a second end pivotally coupled to the footrest coupling.

11. A wheelchair footrest retraction device for use on a wheelchair having a footrest frame portion and a footrest pivotally supported on the footrest frame portion for upward movement from a downward use position to an upper retracted position, the device comprising:

an upper bracket arranged to be mounted on the footrest frame portion;

a handle pivotally coupled to the upper bracket so as to be readily manipulated by a user of the wheelchair, the handle being movable in a forward direction of the wheelchair from a first position to a second position;

a footrest coupling arranged to be mounted on the footrest;

a linkage assembly operatively connected between the handle and the footrest coupling such that the footrest is arranged to be displaced from the downward use position to the upper retracted position in response to forward movement of the handle from the first position to the second position; and an anti-tipping mechanism comprising a support member arranged to be pivotally supported on the footrest frame portion so as to be movable from a raised position in proximity to the footrest to a support position extending downwardly from a bottom end of the footrest frame portion in proximity to the ground responsive to movement of the footrest from the downward use position to the upper retracted position.

12. A wheelchair anti-tipping mechanism in combination with a wheelchair having a main frame supporting a footrest frame portion thereon and a footrest pivotally supported on the footrest frame portion for upward movement from a downward use position to an upper retracted position, the mechanism comprising:

a support member pivotally supported on the footrest frame portion so as to be pivotally movable relative to the footrest frame portion and the main frame of the wheelchair from a raised position in proximity to the footrest to a support position extending downwardly from a bottom end of the footrest frame portion in proximity to the ground responsive to movement of the footrest relative to the footrest frame portion from the downward use position to the upper retracted position.

13. The mechanism according to claim 12 wherein the support member includes a footrest engaging portion arranged to be positively engaged with the footrest as the footrest is displaced from the upper retracted position to the downward use position to urge the support member from the support position to the raised position responsive to the movement of the footrest assembly from the upper retracted position to the downward use position.

14. The mechanism according to claim 13 wherein the anti-tipping mechanism further comprises a biasing member which biases the support member towards the support position.

15. The mechanism according to claim 14 wherein the anti-tipping mechanism further comprises a stop member arranged to be fixed relative to the footrest frame portion, the support member being arranged to positively engage the stop member in the support position so as to prevent continued movement from the raised position towards the support position beyond the support position.

16. The mechanism according to claim 13 wherein:

the support member is arranged to be pivotally coupled to the footrest frame portion for pivotal movement about a pivot axis below the footrest assembly;

the support member comprises a leg portion extending downwardly from the pivot axis in the support position; and the footrest engaging portion extends upwardly from the pivot axis in the support position.

17. The mechanism according to claim 12 wherein the support member is substantially parallel to a frame member of the footrest frame portion in the support position.

18. The mechanism according to claim 12 wherein the anti-tipping mechanism is fastened to the footrest frame portion at an existing fastener location on the footrest frame portion corresponding to a pivot axis of the pivotal movement of the footrest relative to footrest frame portion.

19. The mechanism according to claim 12 wherein a length of the support member extending downwardly from the footrest frame portion in the support position is adjustable.

20. The mechanism according to claim 12 wherein the support member is lowered in the support position relative to the raised position.

* * * * *